United States Patent [19]

Smith et al.

[11] Patent Number: 4,815,351

[45] Date of Patent: Mar. 28, 1989

[54] APPARATUS FOR SLANT PUNCHING A PLURALITY OF ELONGATE HOLES IN A PENETRABLE BLANK OF MATERIAL

[76] Inventors: Don L. Smith; Shirley J. Smith, both of 1683 E. 6550 South, Salt Lake City, Utah 84117

[21] Appl. No.: 92,040

[22] Filed: Sep. 1, 1987

[51] Int. Cl.[4] ..... B26F 1/24

[52] U.S. Cl. ..... 83/868; 83/660; 83/856; 83/858; 83/866

[58] Field of Search ..... 83/868, 866, 660, 856, 83/858; 408/49

[56] References Cited

U.S. PATENT DOCUMENTS

| | | | |
|---|---|---|---|
| 210,866 | 12/1878 | Mahle | 408/49 |
| 390,956 | 10/1888 | Estabrook | 408/49 |
| 411,346 | 9/1889 | Mahle | 408/49 |
| 1,077,929 | 11/1913 | Glidden | 83/868 |
| 2,322,726 | 6/1943 | Carfagno | 83/868 |

*Primary Examiner*—Donald R. Schran

*Attorney, Agent, or Firm*—Thorpe, North & Western

[57] ABSTRACT

The present invention provides novel apparatus for punching or drilling of a plurality of elongate, slanting bores or holes in a substantially solid slab made of a relatively rigid, penetrable material such as plastic. The apparatus comprises a punching or drilling chamber having a substantially planar top wall. A series of spikes angle downwardly and at an angle from the top wall. A feed end allows slabs of material to be fed into the punching chamber onto a planar support bed, where the slab is secured from further movement relative to the support bed. The support bed is movable in reciprocating motion upward and downward in the punching chamber in a direction parallel with the longitudinal axes of the spikes which extend downwardly from the top wall of the chamber. During the upward motion, the slab of material is forced into the spikes which pierce the slab and forms the elongated bores or holes therein. In the downward cycle, the spikes are withdrawn from the slab of material. The slab with the bores or holes formed therein is ejected from the punching chamber by an entering, subsequent slab of material and the punching procedure is repeated.

7 Claims, 4 Drawing Sheets

APPARATUS FOR SLANT PUNCHING A PLURALITY OF ELONGATE HOLES IN A PENETRABLE BLANK OF MATERIAL

BACKGROUND OF THE INVENTION

1. Field of the Invention

The present invention relates generally to apparatus for punching or drilling of a plurality of elongate, slanting bores or holes in a substantially solid slab made of a relatively rigid, penetrable material such as foamed plastic. The slab of material is then used in a marketing device for displaying and selling stemmed items such as candy suckers, wherein the stems of the items are inserted into the elongate bores or holes in the slab of material.

2. State of the Art

Display stands and racks for merchandising stemmed article are quite common. Foamed plastic materials have been used in such displays or racks, with the stems of the articles being pushed into the foamed plastic material. It has been found highly advantageous to provide predrilled bores or holes in the foamed plastic material to facilitate the insertion of the stems of the articles to be carried thereby. A device capable of predrilling a plurality of bores or holes in the foamed plastic material would also be highly advantageous. The device should be capable of repeatedly receiving successive blanks of foamed plastic material and of simultaneously drilling a plurality of elongate bores or holes in each of the successive blanks of foamed plastic material received therein.

A patent search developed only two previous U.S. patents which relate even remotely to machines for punching or drilling a plurality of bores or holes in a blank. These patents, U.S. Pat. Nos. 676,781 and 676,782, were both issued on June 18, 1901 to E. B. Stimpson. The Stimpson patents disclose machines for bevel cutting the edges of leather blanks and oblique punching of holes in leather blanks, wherein the leather blanks are then to be used as uppers in shoes.

3. Objectives

A principal objective of the invention is to provide novel apparatus for simultaneously creating a plurality of elongate, linear bores or holes in a substantially solid slab made of a relatively rigid, penetrable material, such as foamed plastics.

Another objective of the present invention is to provide such novel apparatus which is capable of repeatedly receiving a blank or slab of foamed plastic material, drilling a plurality of elongate bores or holes simultaneously in the blank of foamed plastic material, and ejecting the blank of material having the bores or holes formed therein.

A further objective of the present invention is to provide such novel apparatus which is capable of slant punching or drilling a plurality of bores or holes in a blank or slab of foamed plastic material, wherein the blank or slab containing the bores or holes is used for displaying and marketing of stemmed items such as candy suckers, cut and artificial flowers, screw drivers, tobacco pipes, pencils, pens and similar items.

BRIEF DESCRIPTION OF THE INVENTION

The above objectives are achieved in accordance with the present invention by providing a novel apparatus for simultaneously creating a plurality of elongate, linear bores or holes in a substantially solid slab or blank made of a relatively rigid, penetrable material, wherein the slab or blank is of the type having two spaced, broad, flat faces forming opposite sides which are spaced by a relatively narrow, exposed, perimeter edge wall. The bores or holes are to extend inwardly in a uniform direction from one of the broad, flat faces of the slab or blank, with the elongated bores or holes all being parallel with each other.

The novel apparatus comprises a substantially planar support bed positioned within a punching or drilling chamber. Feed means are provided for feeding successive slabs or blanks into the punching or drilling chamber and onto the planar support bed such that one of the broad, flat faces of the respective slab is substantially exposed to the interior of the chamber when the slab is supported on the planar support bed.

A substantially planar punching or drilling member is located in the punching or drilling chamber. The punching or drilling member is positioned such that an inner, broad, flat face thereof is spaced from and faces the one, flat face of a respective slab which is exposed to the interior of the chamber when the slab is supported on the planar support bed. The punching or drilling member has a plurality of elongate punching or drilling elements extending from the inner face thereof into the punching or drilling chamber. The punching or drilling elements are oriented such that the longitudinal axes thereof are parallel with each other. Further, the longitudinal axes of the punching or drilling elements are slanted at a uniform, oblique angle with respect to the one, flat face of the respective slab which is exposed to the interior of the chamber when the slab is supported on the planar support bed.

Means are provided for moving the planar support bed and planar punching or drilling member in relative, reciprocating movement toward and away from each other in a direction which is parallel with the longitudinal orientation of the plurality of punching or drilling elements extending from the planar punching or drilling member. As the planar support bed and planar punching or drilling member move toward each other, the elongate punching or drilling elements pierce the slab of material supported by the planar support bed to form a plurality of bores or holes in the slab of material. In the retraction portion of the reciprocating movement, the planar support bed and planar punching or drilling member move away from each other, such that the elongate punching or drilling elements are withdrawn from the bores or holes formed in the slab. While the planar support bed and planar punching or drilling member are in their retracted position, the slab which has been pierced so as to form the bores or holes therein is replaced within the punching or drilling chamber by a subsequent, unpierced slab, and the piercing cycle is then repeated.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which:

FIG. 1 a is pictorial representation of a preferred embodiment of slant punching and drilling apparatus in accordance with the present invention, showing the upper plate of the apparatus in exploded position to reveal the punching and drilling chamber located thereunder;

FIG. 2 is vertical cross section of the apparatus of FIG. 1 taken along the line 2—2 of FIG. 1;

FIG. 2*a* is a partial plan view of the corner of the planar support bed of the apparatus of FIG. 1 showing how the exit gate is pivotally attached to the bed with a spring which biases the gate to an elevated, operating condition.

DETAILED DESCRIPTION OF THE ILLUSTRATED EMBODIMENTS

There is shown in FIGS. 1–6 one complete and preferred embodiment of apparatus of the present invention for simultaneously creating a plurality of elongate, linear bores or holes in a substantially solid slab or blank made of a relatively rigid, penetrable material.

Figure 1:
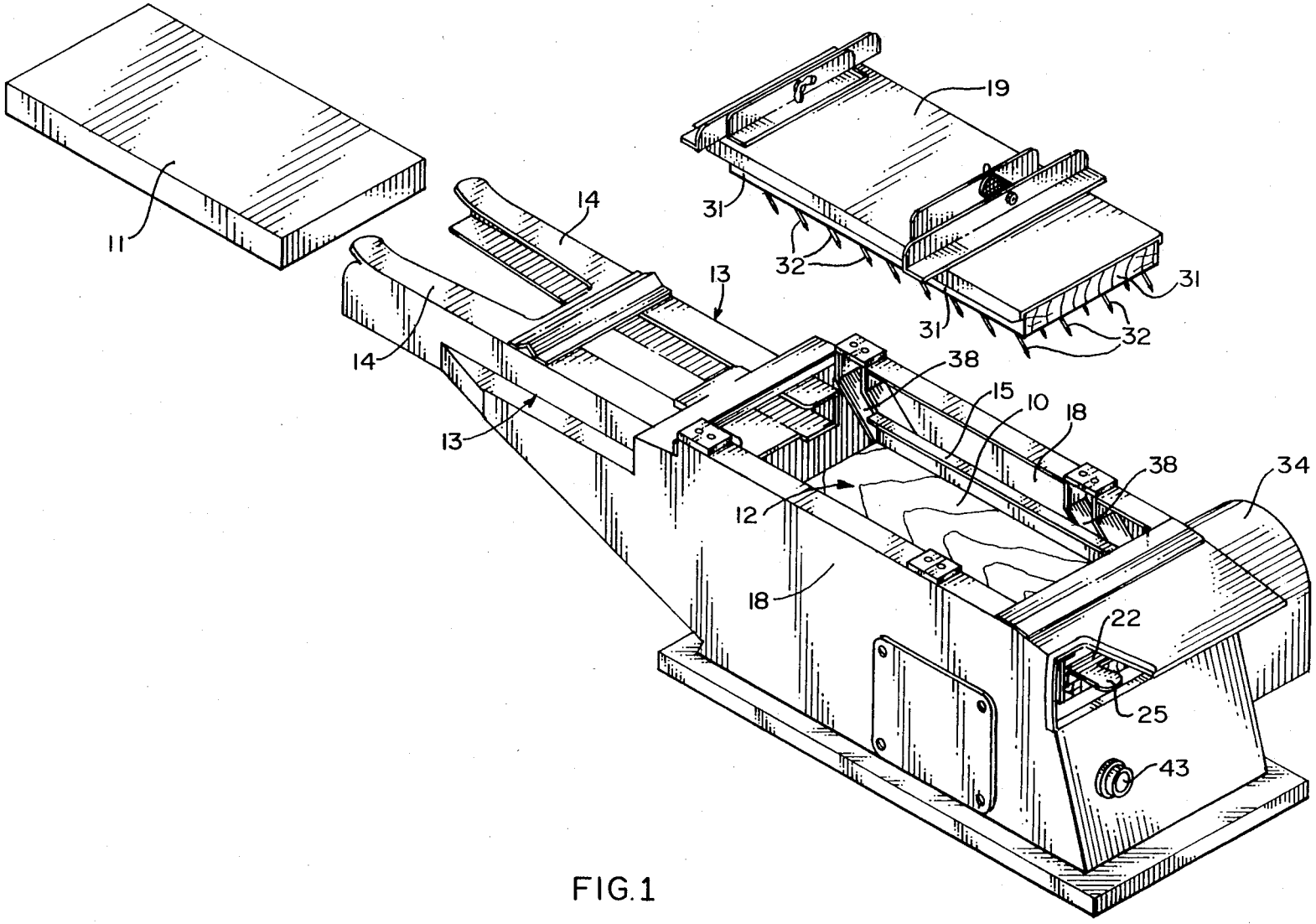

The apparatus comprises a substantially planar support bed 10 for supporting a slab or blank 11 of a penetrable material within a punching or drilling chamber 12. As shown in FIG. 1, the slab 11 is shown in position to be inserted into the feed chute 13 from where the slab 11, as will be explained in more detail hereinafter, moves onto the planar support bed 10 within the chamber 12. The slab 11 can be made of various materials which can readily be penetrated with a sharp probe or drill. Preferably, the slab 11 is made of a foamed or expanded plastic material, such as expanded polystyrene.

The punching or drilling chamber 12 is defined by the opposite, lateral sides 18 of the apparatus, the feed chute 13 at one end of the chamber 12 and an exit gate 22 at the other end of the chamber 12. The top of the chamber 12 comprises a top plate 19 which is attached as by screws (not shown) to the top side edges of the lateral sides 18 of the apparatus. The bottom of the chamber 12 is formed by the planar support bed 10.

The feed chute 13 comprises a pair of oppositely faced channels 14 which open toward each other. Respective, one ends of the channels 14 are positioned adjacent one end of the planar support bed 10 and appropriately spaced from the planar support bed 10. As will be explained fully hereinafter, the planar support bed 10 is adapted to move upwardly in a slanting direction toward the end of the chamber 12 formed by the feed chute 13. The ends of the channels 14 forming the feed chute 13 must be spaced from the end of the planar support bed 10 sufficiently to allow the relative movement of the planar support bed 10.

In its lowered or retracted position, the upper surface of the planar support bed 10 is in alignment with the lower legs of the channels 14 of the feed chute 13. Thus, the slab 11 can be slid through the feed chute 13 along the channels 14 and onto the upper surface of the planar support bed 10, such that one of the broad, flat faces (the upper face) of the slab 11 is substantially exposed to the interior of the chamber 12 when the slab 11 is supported on the planar support bed 10. The feed chute 13 has a longitudinal dimension somewhat greater than the longitudinal dimension of the slab 11. This allows one slab to be held awaiting the punching or drilling operation in the feed chute 13. To advance the waiting slab into the chamber 12, a subsequent slab is introduced to the lead end of the feed chute 13 and is used to push the previous slab into the chamber and onto the planar support bed 10. Any perforated or drilled slab in the chamber 12 will be simultaneously ejected from the chamber 12 by passing through the exit gate 22.

A substantially planar punching or drilling member 31 is positioned within the chamber 12 and oriented such that an inner, broad, flat face of the member 31 faces the one, broad, flat face of the slab 11 which is supported on the planar support bed 10. In the illustrated embodiment of the apparatus, the punching or drilling member 31 is positioned immediately adjacent to the top plate 19 covering the chamber 12. As illustrated, the punching or drilling member 31 comprises a wooden board which is attached securely to the underside of the top plate 19. The lateral side edges of the top plate 19 are preferably bent downwardly to abut the side edges of the wooden board member 31.

A plurality of punching or drilling elements 32 extend downwardly from the inner face of the punching or drilling member 31 into the chamber 12, with the longitudinal axes of the punching or drilling elements 32 being parallel with each other. Further, the longitudinal axes of the punching or drilling elements 32 are oriented at a uniform, oblique angle with respect to the one, broad, flat face of the slab 11 which is supported on the planar support bed 10. The acute angle formed between the punching or drilling elements 32 and the punching or drilling member 31 of the preferred embodiment is between about 30 degrees and 75 degrees, most preferably between about 40 degrees and 50 degrees.

The punching or drilling elements 32 can advantageously be nails driven through the wooden member 31 so that the pointed ends of the nails extend downwardly from the inner surface of the member 31. The pointed nails will pierce most materials which are to be used to make the slabs 11, that is, foamed or expanded plastic materials. However, it may be desirable to make the slab 11 of a more hard material such as wood or unfoamed, unexpanded plastic. When the slab 11 is make of these latter materials, it is preferable to make the punching or drilling elements 32 from twist drills. Means would then be provided as is well known in the art for concurrently turning the twist drills about their axes to drill into the slab 11.

Means are provided for moving the planar support bed 10 and the planar punching or drilling member 31 in relative, reciprocating movement toward and away from each other in a direction which is parallel with the longitudinal orientation of the plurality of elongate punching or drilling elements 32 which extend from the punching or drilling member 31. As the planar support bed 10 and the planar punching or drilling member 31 move toward each other, the punching or drilling elements 32 pierce the slab 11 supported by the planar support bed 10 to form the plurality of bores or holes in the slab 11. The reciprocal movement is cyclic, that is, the planar support bed 10 and punching or drilling member 31 move toward each other and away from each other in each cycle, with the planar support bed 10 and the punching or drilling member 31 being located at their spaced apart positions between cycles. During each cycle, the punching or drilling elements 32 pierce the slab 11 to form the plurality of bores or holes therein, and then the punching or drilling elements 32 are retracted such that the slab 11 with the bores or holes formed therein can be removed from the apparatus and replaced with a subsequent slab 11.

Figure 2:
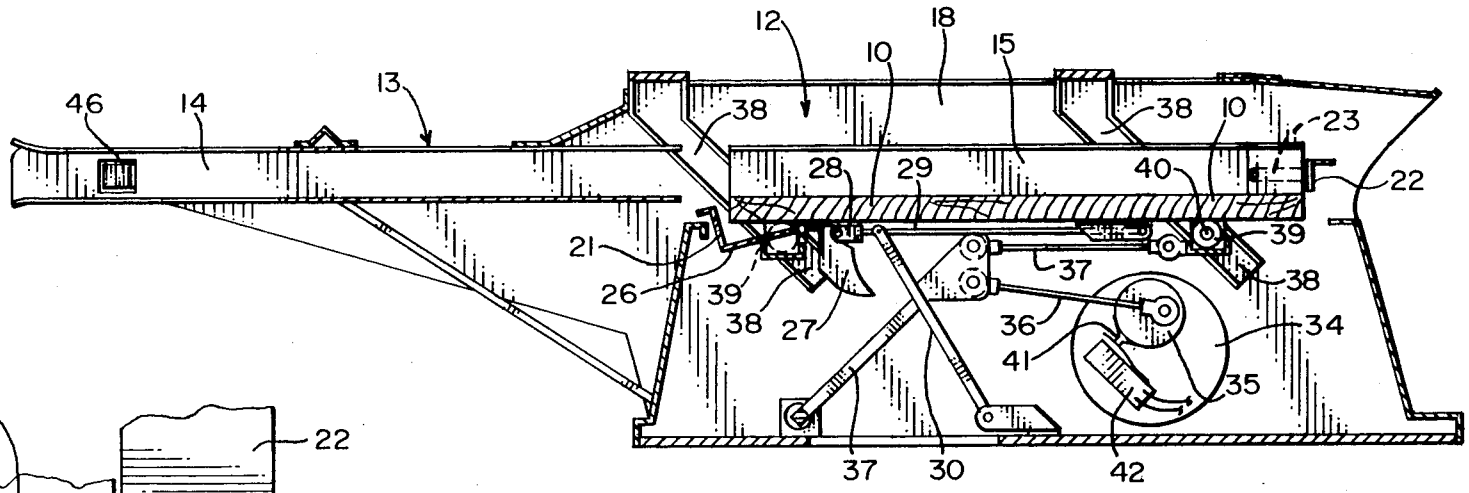

As illustrated, the planar support bed 10 is made to be movable with respect to the fixed punching or drilling member 31, and the means for moving the planar support bed 10 comprised a drive motor 34 which is operably connected to the planar support bed 10 by appropriate drive means. As best illustrated in FIG. 2, the motor 34 has an eccentric drive wheel 35 which is pivotally attached to a push rod 36. The push rod 36 is in turn pivotally connected to an articulated drive member 37 which is attached to and drives the planar support bed 10 in its reciprocating motion. The planar support bed 10 is guided in a slanting movement up and down while the planar top thereof is maintained in a substantially horizontal orientation so as to be parallel with the punching or drilling member 31.

Figure 6:
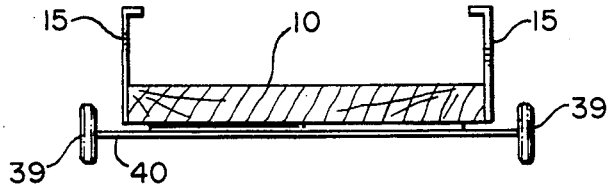
FIG. 6 is a transverse cross section of the planar support bed of the apparatus of FIG. 1 taken generally along the line 6—6 of FIG. 1 so as to show the track wheels associated with the bed for guiding the bed in its movement along the guide tracks located on the opposite sides of the punching and drilling chamber of the apparatus.

The guidance mechanism comprises a pair of spaced, guide tracks 38 positioned on each of the opposite sides 18 of the apparatus and the chamber 12. The guide tracks 38 slant upwardly so as to be parallel with the longitudinal axes of the punching or drilling elements 32. As shown in FIGS. 2 and 6, the planar support bed 10 has two pair of spaced apart wheels 39 located on the opposite lateral sides of the planar support bed 10, with mutually respective wheels 39 on one side being connected through axles 40 to the wheels 39 on the other side. The wheels 39 run up and down in the guide tracks 38 which take the form of oppositely faced channels in which the wheels 39 glide. It is to be recognized, of course, that other embodiments of sliding members in place of the wheels 39 can be used in combination with various guide tracks configurations for guiding the planar support bed 10 in its reciprocating motion.

The drive wheel 35 on the motor 34 has a cam 41 which activates a switch 42 on each cycle of the drive wheel 35. The switch 42 is electrically connected to an push button 43 (FIG. 1) on the end panel of the apparatus. When the operator pushes the button 43, the motor 34 is activated to move the drive wheel 35. Upon one rotation of the drive wheel 35, the cam 41 activates the switch 42 to terminate that particular cycle and to set the push button 43 in a state ready to initiate a new cycle.

In the preferred embodiment as illustrated in the drawings, means are provided for retaining the slab 11 in a fixed position relative to the planar support bed 10 during the reciprocating motion of the planar support bed 10. Such means comprises a pair of channels 15 positioned along the opposite side edges of the planar support bed 10. The planar support bed 10 can be made of a piece of wooden board as shown, with the channels 15 being attached firmly to the side edges of the wooden board. As can be seen from the drawings, the slab 11 can be positioned on the planar support bed 10 by sliding opposite edges of the slab 11 into engagement with the pair of oppositely faced channels 15.

Figure 2A:
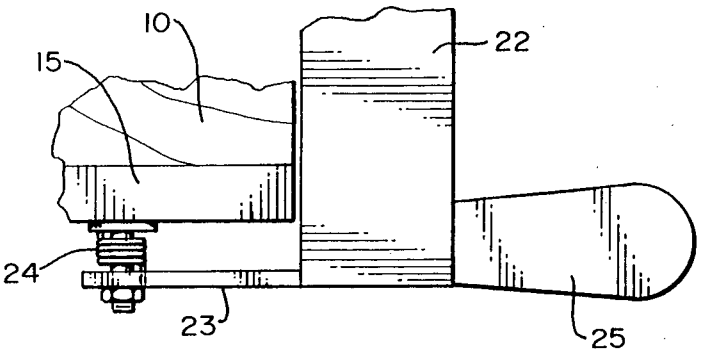

The means for retaining the slab 11 in a fixed position relative to the planar support bed 10 further advantageously comprises a pair of end gates 21 and 22 positioned respectively at each of the opposite ends of the planar support bed 10. The exit gate 22 has been referred to above. It forms a stop for the sliding motion of the slab 11 as the slab is positioned on the planar support bed 10. The end gate 22 as illustrated comprises an elongate angle which is pivotally mounted at its ends to the respective sides of the planar support bed 10 by pivot arms 23. The end gate 22 is biased in an extended position wherein the angle is positioned across the exit end of the planar support bed 10 as shown in FIG. 2. A coil spring 24 as shown in FIG. 2*a* is associated with at least one of the pivot arms 23. The coil spring 24 biases the exit gate 22 into the extended position across the exit end of the planar support bed 10. A finger tab 25 extends from one corner of the exit gate 22 for pushing the gate into its retracted position below the planar support bed 10. In the retracted position, the slab 11 of material in the chamber 12 can be pushed or ejected from the end of the planar support bed 10.

The gate 21 at the entrance end of the planar support bed 10 is automatically made to be raised into an operating position extending across the entrance end of the planar support bed 10 whenever the planar support bed 10 is being moved in its reciprocating motion. A drive arm 26 is attached at one of its ends to the gate 21. The drive arm 26 extends beneath the planar support bed 10 and is pivotally attached to the underside of the planar support bed 10. A portion of the drive arm 26 extends beyond the pivotal connection to the underside of the planar support bed 10 and has a cam 27 attached thereto. A cam activator 28 is associated with the planar support bed 10 for driving the cam 27 and pivoting the gate 21 into its upwardly extending position whenever the planar support bed 10 is in motion up and down along the guide tracks 38.

The cam activator 28 is connected to the end of a rod 29 whose opposite end is pivotally attached at a spaced distance along the longitudinal length of the planar support bed 10. A second rod 30 is pivotally attached at its upper end to the first rod 29 at a point adjacent to the cam activator 28. The second rod 30 extends downwardly and is attached to the floor or other bottom frame member of the apparatus. As the planar support bed 10 begins to move upwardly, the second rod 30 pulls the end of the first rod 29 and the cam activator 28 thereon downwardly which drives the cam 27 to pivot the gate 21 into its upwardly extending position. The gate 21 is not lowered into its retracted position until the planar support bed 10 returns to its lowermost, rest position.

In operation of the apparatus, a first slab 11 is introduced into the feed chute 13 by sliding the slab into the respective channels 14 thereof. A second slab 11 is then slid into the feed chute 13 so as to move the first slab forward onto the planar support bed 10 in the chamber 12. The planar support bed 10 is in its lowered rest position, with the gate 21 is in its lowered position so that the first slab can slide freely onto the planar support bed 10 in the chamber 12. The first slab is pushed forward until its leading end abuts the exit gate 22. After positioning the first slab, the second slab, i.e., the one in the feed chute 13 must be withdrawn from contact with the trailing end of the first slab, that is the slab positioned on the planar support bed 10 in the chamber 12. Otherwise, the planar support bed 10 and the first slab thereon would impinge and push upon the forward end of the second slab in the feed chute 13 when the planar support bed 10 begins to move upwardly in slanting movement along the guide tracks 38.

The slab in the feed chute 13 is conveniently moved backward in the feed chute 13 until the trailing edge thereof abuts a spring activated stop 46 associated with the feed chute 13. The stop 46 is movable in and out of the side channel 14 of the feed chute 13. A slab of material pushes the stop out of the channel when the slab is moving forwardly into the feed chute 13. Once the trailing end of the slab has passed the stop 46, the stop projects into the channel 14. When the slab is moved backwardly in the feed chute 13, the trailing end of the slab abuts the stop 46 to limit the degree of backward movement.

Figure 3:
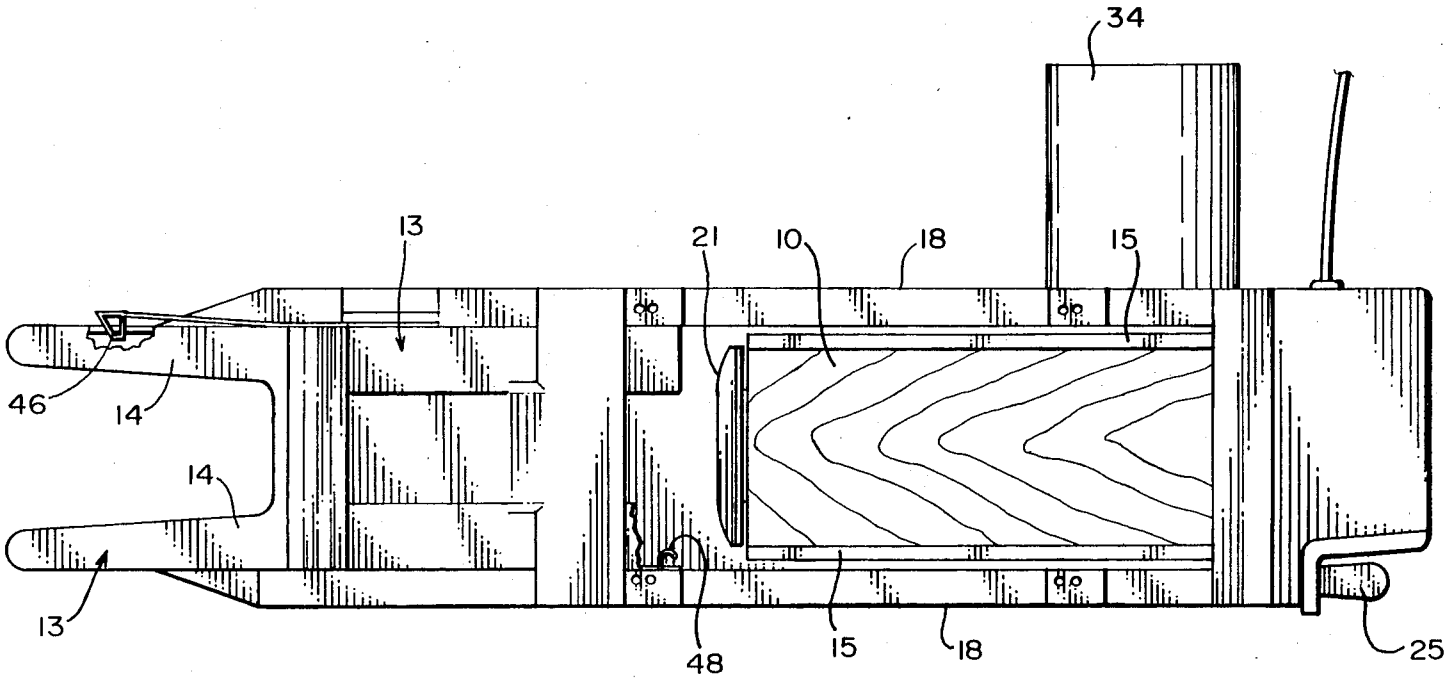
FIG. 3 is a top plan view of the apparatus of FIG. 1, with the upper plate thereof being removed to show the planar support bed in the punching and drilling chamber of the apparatus.
Figure 4:
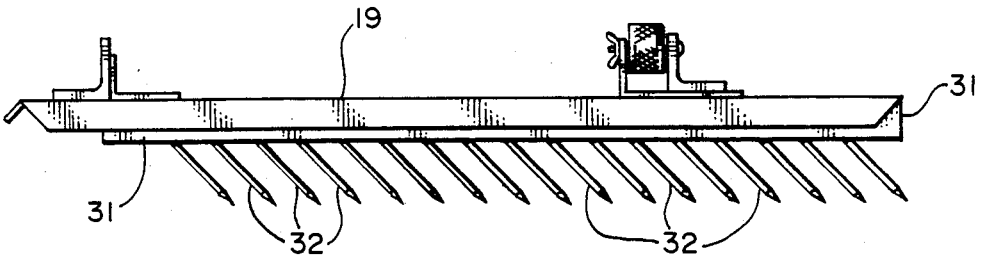
FIG. 4 is a vertical elevation of the top plate of the apparatus of FIG. 1 showing the punching and drilling elements extending downwardly therefrom.
Figure 5:
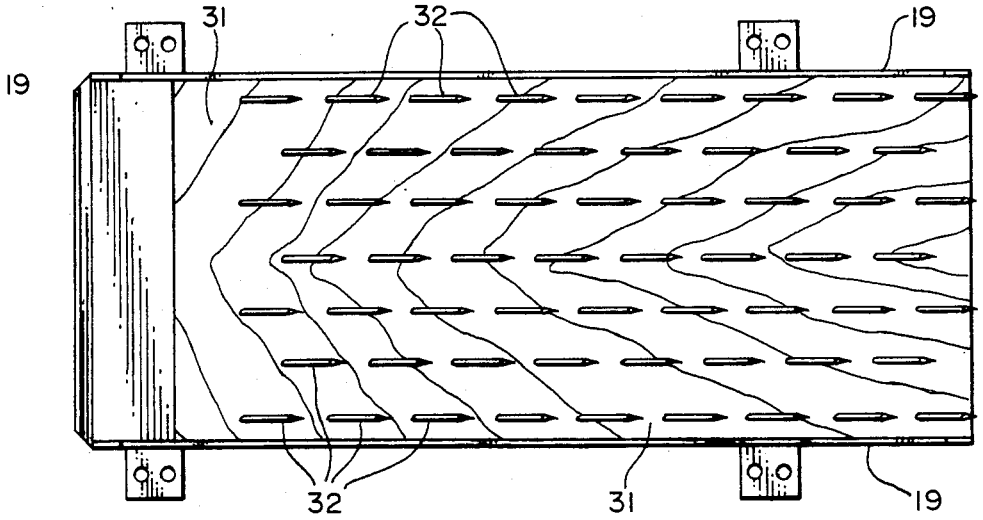
FIG. 5 is a bottom, plan view of the top plate of FIG. 4.

To be sure that the leading end of the second slab has been retracted or moved backwardly by a sufficient distance to not impede the planar support bed 10 in its slanting, upward movement, the feed chute 13 is provided with an override means which prevents relative movement of the planar support bed 10 whenever a slab of material is contained in the feed chute 13 at a position in which the leading end of the slab in the feed chute 13 is within a preset distance from the adjacent end of the planar support bed 10. As shown in FIG. 3 sensor arm 48 is positioned at the proper distance from the adjacent end of the planar support bed 10. The sensor arm 48 is capable of sensing when a portion of the slab in the feed chute 13 is adjacent to the sensor arm 48. Under such circumstances, the sensor arm 48 activates an override switch (not shown) which incapacitates the motor 34 such that the planar support bed 10 cannot b driven in its reciprocating motion. Once the slab of material in the feed chute 13 has been retracted back of the sensor arm 48, the motor 34 can be operated to move the planar support bed 10.

Once the two slabs have been properly positioned in the apparatus, the push button 43 is pushed, and the motor 34 drives the planar support bed 10 in one cycle, i.e., in an upward movement whereby the bores or holes are formed in the slab positioned on the planar support bed 10 and then in a downward movement to withdraw the punching or drilling elements 32 from the bores or holes formed in the slab. The planar support bed 10 returns to its rest position, and the slab containing the newly formed bores or holes is removed from the chamber 12 of the apparatus. With the apparatus as illustrated, the slab is removed by manually depressing the tab 25 on the exit gate 22 to lower the gate 22. Another slab of material is then pushed into the feed chute 13 to push the slab already in the feed chute 13 forward into the chamber 12 and to, in turn, push the slab with the newly formed bores or holes from the chamber 12. The procedure is repeated as desired to produce the desired number of slabs containing the bores or holes.

Although a preferred embodiment of the apparatus of the present invention has been illustrated and described, it is to bed understood that the present disclosure is made by way of example and that various other embodiments are possible without departing from the subject matter coming within the scope of the following claims, which subject matter is regarded as the invention.

We claim:

1. Apparatus for simultaneously creating a plurality of elongate, linear bores or holes in a substantially solid slab made of a relatively rigid, penetrable material wherein said slab comprises two spaced, broad, flat faces forming opposite sides thereof and a relatively narrow exposed perimeter edge wall, and wherein further the elongate bores or holes extend inwardly in a uniform direction from one of the broad, flat faces of said slab, with the elongate bores or holes all being parallel with each other, said apparatus comprising a substantially planar support bed for supporting said slab of material within a punching chamber such that one of the broad, flat faces of said slab is substantially exposed to the interior of said chamber as said slab is supported on said bed;

a substantially planar punching member positioned within said chamber such that an inner, broad, flat face of said punching member faces said one, broad, flat face of said slab which is support on said bed;

a plurality of elongate punching elements extending into said chamber from said inner face of said punching member, with the longitudinal axes of said punching elements being parallel with each other, and further with said longitudinal axes of said punching elements being oriented at a uniform, oblique angle with respect to said one, broad, flat face of said slab which is supported on said bed;

means for moving the planar support bed and the planar punching member in relative, reciprocating movement toward and away from each other in a direction which is parallel with the longitudinal orientation of the plurality of elongate punching elements extending from said planar punching member; and means for retaining the slab of material in a fixed position relative to the planar support bed during the relative, reciprocating movement of the planar support bed and the planar punching member, said means for retaining the slab of material in a fixed position comprising a pair of channels position along opposite side edges of said planar support bed so as to face each other, such that the slab of material can be positioned on said planar support bed by sliding opposite edges of the slab of material into engagement with the pair of oppositely faced channels, whereby said elongate punching elements pierce said slab of material supported by said planar support bed during the relative, reciprocating movement of the planar support bed and the planar punching member to form said plurality of bores or holes in said slab of material.

2. Apparatus in accordance with claim 1, wherein said means for retaining the slab of material in a fixed position further comprises a pair of end gates positioned respectively at each of the opposite ends of said planar support bed, with the end gates being movable from a working position in which the gates form a barrier for the sliding movement of a slab of material positioned on said planar support bed to a retracted position in which the gates do not form a barrier for sliding movement of a slab of material positioned on said planar support bed.

3. Apparatus in accordance with claim 1, wherein a feed chute is provided adjacent one of the ends of said planar support bed for guiding a slab of material in a sliding movement onto the planar support bed when the end gate at the one end of said planar support bed is in its retracted position.

4. Apparatus in accordance with claim 1, wherein the feed chute is provided with an override means which prevents relative movement of the planar support bed and the planar punching member whenever a slab of material is contained in said chute at a position in which the leading end of said slab in said chute is within a preset distance from the adjacent end of said planar support bed.

5. Apparatus in accordance with claim 1, wherein said punching chamber has a pair of guide tracks located on opposite sides thereof;

said planar support bed has sliding members which engage mutually respective guide tracks on the sides of the punching chamber; and means are provided for moving the planar support bed back and forth along the guide tracks to produce the relative, reciprocating movement of the planar support bed and the planar punching and drilling member.

6. Apparatus in accordance with claim 1, wherein the planar punching member is positioned adjacent the top of the punching chamber, and the planar support bed moves upwardly and downwardly within said chamber in a reciprocating movement towards and away from said planar punching member.

7. Apparatus in accordance with claim 1, wherein the punching elements comprise a plurality of spaced spikes extending from said inner face of said punching member.

* * * * *